US006134411A

United States Patent [19]

Meyer et al.

[11] Patent Number: 6,134,411

[45] **Date of Patent: *Oct. 17, 2000**

[54] TONER CARTRIDGE ASSEMBLY

[75] Inventors: Merle L. Meyer, Burnsville; Steven A. Thompson, Golden Valley, both of Minn.

[73] Assignee: Katun Corporation, Minneapolis, Minn.

[ * ] Notice: This patent is subject to a terminal disclaimer.

[21] Appl. No.: 09/425,651

[22] Filed: Oct. 22, 1999

Related U.S. Application Data

[62] Division of application No. 09/197,135, Nov. 20, 1998.

[51] Int. Cl.[7] ..... G03G 15/08

[52] U.S. Cl. ..... 399/262; 399/263; 222/DIG. 1

[58] Field of Search ..... 399/262, 263, 399/258; 222/DIG. 1

[56] References Cited

U.S. PATENT DOCUMENTS

| | | | |
|---|---|---|---|
| 3,853,246 | 12/1974 | Dubois | 222/168 |
| 3,915,340 | 10/1975 | Koeleman | 222/23 |
| 4,212,264 | 7/1980 | Knechtel et al. | 118/653 |
| 5,455,662 | 10/1995 | Ichikawa et al. | 355/260 |
| 5,500,719 | 3/1996 | Ichikawa et al. | 355/260 |
| 5,627,631 | 5/1997 | Ichikawa et al. | 355/260 |
| 5,655,180 | 8/1997 | Yasuda et al. | 399/106 |
| 5,765,079 | 6/1998 | Yoshiki et al. | 399/258 |
| 5,822,663 | 10/1998 | Ichikawa et al. | 399/262 |
| 5,903,806 | 5/1999 | Matsuoka et al. | 399/258 |

*Primary Examiner*—Arthur T. Grimley
*Assistant Examiner*—Greg Moldafsky
*Attorney, Agent, or Firm*—Schwegman, Lundberg, Woessner & Kluth, P.A.

[57] ABSTRACT

A cartridge unit is for use with a toner cartridge assembly of an image developing device. The cartridge unit has a cartridge including a toner bottle coupled with a cap assembly, where the toner bottle includes an elongate cylindrical structure which has a central axis. The cap assembly is coupled with the toner bottle and includes a mouth portion. At least one scoop is coupled within the mouth portion of the cap assembly, where the scoop is adapted for drawing developer from the toner bottle through the mouth portion as the toner bottle is rotated about the central axis.

27 Claims, 14 Drawing Sheets

TONER CARTRIDGE ASSEMBLY

This application is a Divisional of U.S. Ser. No. 09/197,135, filed Nov. 20, 1998.

FIELD OF THE INVENTION

The present invention relates generally to containers for developer. More particularly, it pertains to containers for supplying toner to an electrostatic image forming apparatus.

BACKGROUND OF THE INVENTION

The developing unit of an electrostatic image forming apparatus has a toner hopper for storing supply toner. When the supply of toner has become exhausted, toner is added to the image forming apparatus. In order to supply toner to the hopper, a toner cartridge is removably coupled with or proximate to the toner hopper and toner is deposited therein. The addition of toner, frequently conducted in work areas, becomes problematic since the toner is typically supplied as a powder in small particles which can easily soil a person's clothing or hands and the surrounding area, which is undesirable in an office environment. As a result, toner cartridges are mounted within the image forming apparatus and/or have been provided with sealing devices to prevent unnecessary or inadvertent scattering of toner as the image forming apparatus is replenished with toner.

One example of a sealing device is an elastic sheet which removably covers a toner supplying aperture formed in the bottom of a toner cartridge. However, when the sheet is removed to transfer toner from the cartridge to the hopper, toner attached to the sheet scatters inside and outside of the image forming apparatus. In addition, once the plastic sheet has been removed, it cannot be re-attached to cover the opening if necessary. Thus, if a container is inadvertently opened, it cannot be easily resealed.

For toner cartridges which are mounted within the image forming apparatus, the cartridge may be mounted horizontally within the image forming apparatus, and the cartridge is rotated about its longitudinal axis. Examples of a such toner container are shown in the following U.S. Pat. Nos.: 5,455,622 entitled Developer Replenishing Device and Developer Container For Use Therewith to Ichikawa et al. on Oct. 3, 1995; 5,500,719 entitled Developer Replenishing Device and Developer Container For Use Therewith to Ichikawa et al. on Mar. 19, 1996; and 5,627,631 entitled Developer Replenishing Device and Developer Container For Use Therewith to Ichikawa et al. on May 6, 1997.

The distribution of toner to a developing apparatus using a container mounted within the developing apparatus can also become problematic. For instance, as a toner container is rotated, the developer therein must be consistently and efficiently distributed to the developing apparatus. However, for different image forming devices, different types of toner may be required, and different toner container may be necessary for each different type of toner.

Accordingly, what is needed is a toner container assembly which securely and effectively seals the container and can be re-sealed in case of inadvertent opening. What is further needed is a toner container assembly which prevents operator error in opening and closing openings and/or sealing devices of the toner container assembly. What is also needed is a toner container assembly which efficiently distributes toner to a developing apparatus, and can accommodate a wide variety of toner types.

SUMMARY OF THE INVENTION

A cartridge unit for supplying toner to an image developing device. The cartridge unit includes a toner bottle coupled with a cap assembly, where the toner bottle has an elongate cylindrical structure which has a central axis. The cap assembly is coupled with the toner bottle and includes a mouth portion extending from a first shoulder. At least one scoop is coupled within the mouth portion of the cap assembly, where the scoop is adapted for drawing developer from the toner bottle through the mouth portion as the toner bottle is rotated about the central axis. The scoop apparatus is coupled with an internal surface of the mouth portion, and extends partially within the mouth portion.

The scoop apparatus includes several different configurations, and can be coupled with the mouth portion in a number of manners. For instance, in one embodiment, the scoop apparatus further includes an anti-rotation feature which prevents the scoop apparatus from moving relative to the cap assembly. In another embodiment, the scoop apparatus is coupled within the mouth portion with a snap fit coupling. Alternatively, the cap assembly further includes an annular gasket which seals between the cap assembly and the toner bottle.

The scoop apparatus can be formed in a number of different configurations. For instance, in one embodiment, the scoop apparatus includes two scoops interlocked together. The scoops include interlocking tabs which are snap-fitted together in one embodiment. One or both of the scoops has a first portion which is proximate to the mouth, and a second portion which is proximate to a distal end of the scoop. The first portion is defined in part by a first axis and the second portion defined in part by a second axis, wherein the first axis is disposed transverse to the second axis. The first portion has a semi-circular cross-section which transitions to a quarter-circular cross-section at the second portion. In another embodiment, an outer edge of the first portion is aligned with an outer edge of the second portion. In another configuration, the radius of the first portion is substantially the same as the radius of the second portion. In yet another embodiment, the distal end of the second portion is tapered, and can also be substantially tapered away from a shoulder portion of the cap assembly.

In yet another embodiment, a cartridge unit is described which supplies toner to an image developing device. The cartridge unit includes a toner bottle coupled with a cap assembly, where the toner bottle has an elongate cylindrical structure which has a central axis. The cap assembly is coupled with the toner bottle and includes a mouth portion extending from a first shoulder. At least one scoop is coupled within the mouth portion of the cap assembly, where the scoop is adapted for drawing developer from the toner bottle through the mouth portion as the toner bottle is rotated about the central axis. The scoop apparatus is coupled with an internal surface of the mouth portion, and extends partially within the mouth portion. The scoop apparatus includes a scoop coupled with a distribution member, and is adapted for drawing developer from the toner bottle through the mouth portion as the toner bottle is rotated about the central axis. In one embodiment, the scoop apparatus includes three scoops coupled with the distribution member.

The distribution member, in one embodiment, includes a cone aligned with the central axis of the toner bottle. The cone optionally includes a flange which prevents toner from spilling back into the toner bottle. The distribution member includes coupling features which allow for the scoop apparatus to be coupled with the cap assembly. In one embodiment, the coupling features include an annular groove disposed within the collar. The coupling features allow for the scoop apparatus to be removably coupled, in one embodiment, with the cap assembly.

In another configuration, a cartridge unit is provided for supplying toner to an image developing device. The cartridge unit includes a toner bottle coupled with a cap assembly, where the toner bottle has an elongate cylindrical structure which has a central axis. The cap assembly is coupled with the toner bottle and includes a mouth portion extending from a first shoulder. At least one scoop is coupled within the mouth portion of the cap assembly, where the scoop is adapted for drawing developer from the toner bottle through the mouth portion as the toner bottle is rotated about the central axis. The scoop apparatus is coupled with an internal surface of the mouth portion, and extends partially within the mouth portion. The scoop apparatus comprising an enclosed conduit extending from a proximal end to an open distal end. The scoop apparatus is removably coupled with the cap assembly.

The enclosed conduit is arcuately curved from the proximal end to the open distal end, where the proximal end defines a first portion having a first axis and the distal end defines a second portion having a second axis. In one configuration, the first axis is substantially transverse to the second axis. The enclosed conduit can be formed in other configurations. For instance, the open distal end can include a flat edge, and/or the first portion can have a circular cross-section.

Advantageously, the cartridge unit described herein provides a convenient way to draw toner from the toner bottle through the mouth portion of the cap assembly. The various configurations of the toner distribution features allow for a variety of types of toner to be used and yet the velocity of distribution can be ensured. In addition, the dispense rate can be increased. A further advantage provided is that the parts are modular and can be interchangeably used to allow for different types of toner.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
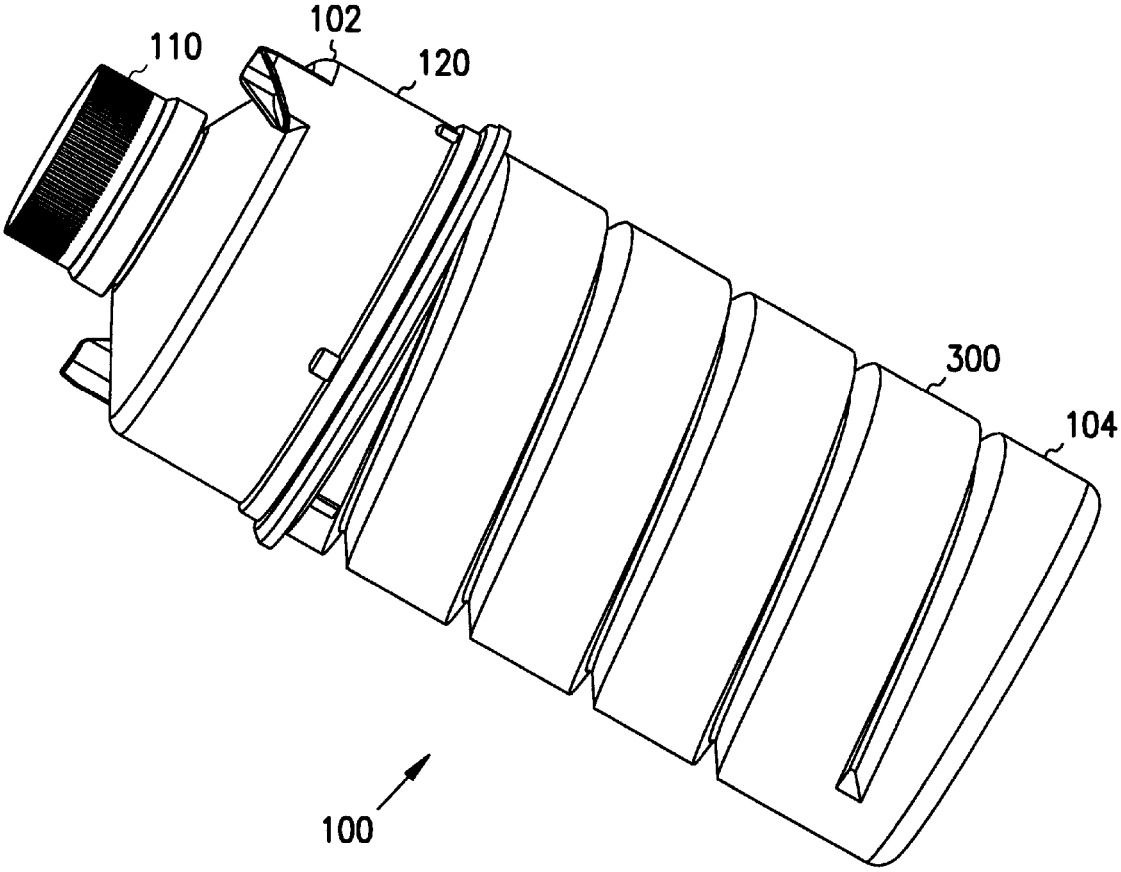
FIG. 1 illustrates a side elevational view of a cartridge unit constructed in accordance with one embodiment of the present invention.

As illustrated in FIG. 1, a cartridge unit 100, is described herein which is adapted to supply toner to a developing apparatus for making photocopies. The cartridge unit 100 is rotatably mounted within the developing apparatus. As the cartridge unit 100 is rotated, developer or toner is supplied to the developing apparatus. Although the term toner is used, the cartridge unit 100 could also be used to supply developer, powder, and the like. The cartridge unit 100 extends from a proximal end 102 to a distal end 104. As illustrated more clearly in FIG. 2, the cartridge unit 100 includes a toner bottle 300, a scoop assembly 200, a cap assembly 120, and an outer cap assembly 110.

The outer end cap assembly 110 includes a distal end cap 112 and a sealing cap 114. The distal end cap 112 is internally threaded such that it can be coupled with the mouth portion 126. Alternatively, the distal end cap 112 can be coupled with the mouth portion 126 of the cap assembly 120 in other manners, such as a snap fit assembly. The outer end cap assembly 110 further includes a sealing cap 114. The sealing cap 114 fits within the mouth portion 126 and, when installed, is adapted for preventing toner from exiting the bottle. The sealing cap 114 includes a lug 116, which allows for the sealing cap 114 to be automatically removed from the toner bottle by the developing apparatus.

A chucking portion of the developing apparatus is adapted to retain the lug 116 of the sealing cap 114. As the chuck is moved away from the bottle, the sealing cap 114 is moved to a position where the mouth portion 126 of the bottle is fully uncovered and toner can be freely distributed through the mouth portion 126 of the cap assembly 120. Once the toner in the bottle has been depleted, the sealing cap 114 is inserted into the mouth portion 126 such that the remaining toner will not exit the bottle as the cartridge unit 100 is removed from the developing apparatus.

Figure 2:
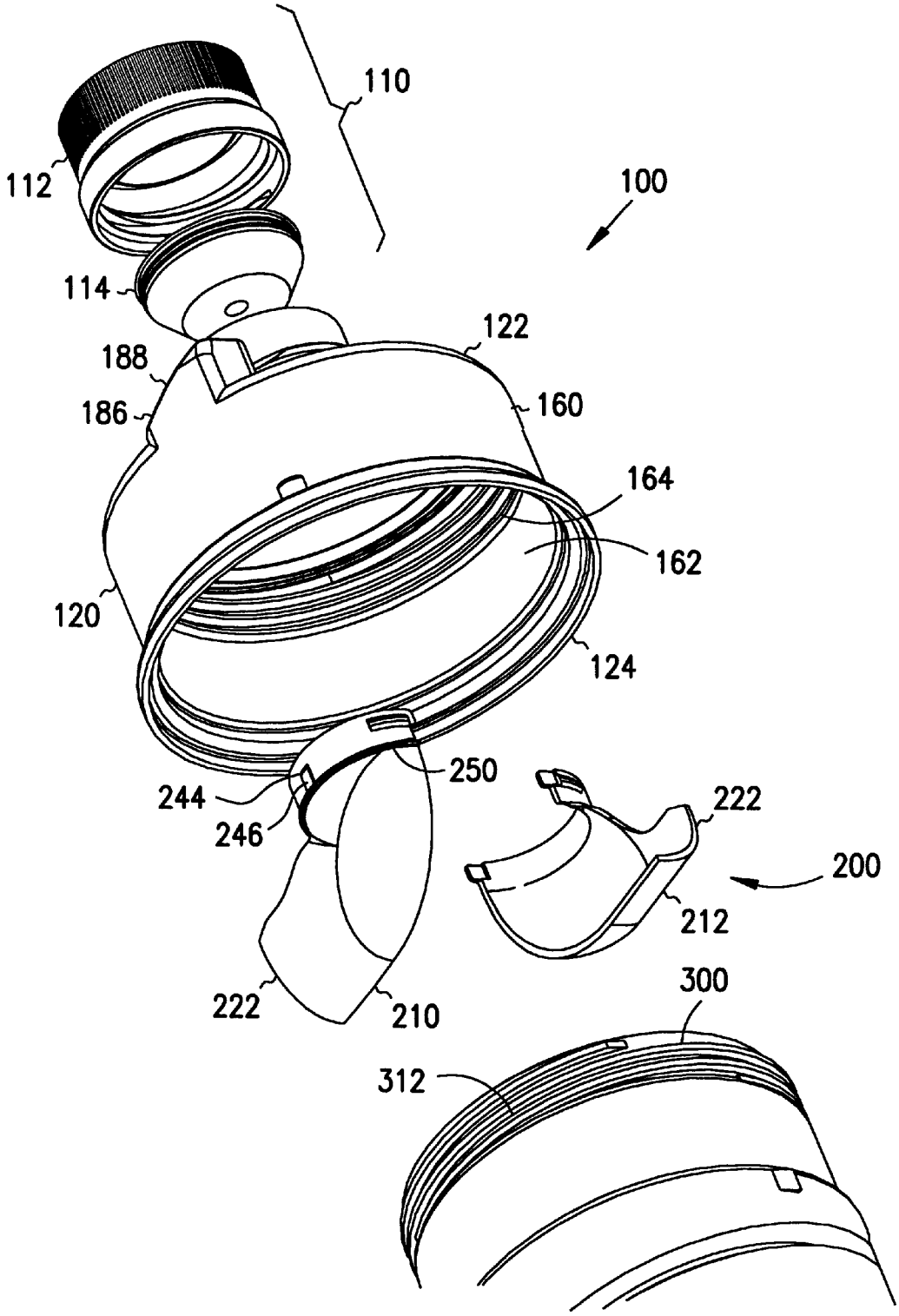
FIG. 2 illustrates an exploded perspective view of a cartridge unit constructed in accordance with one embodiment of the present invention.
Figure 3:
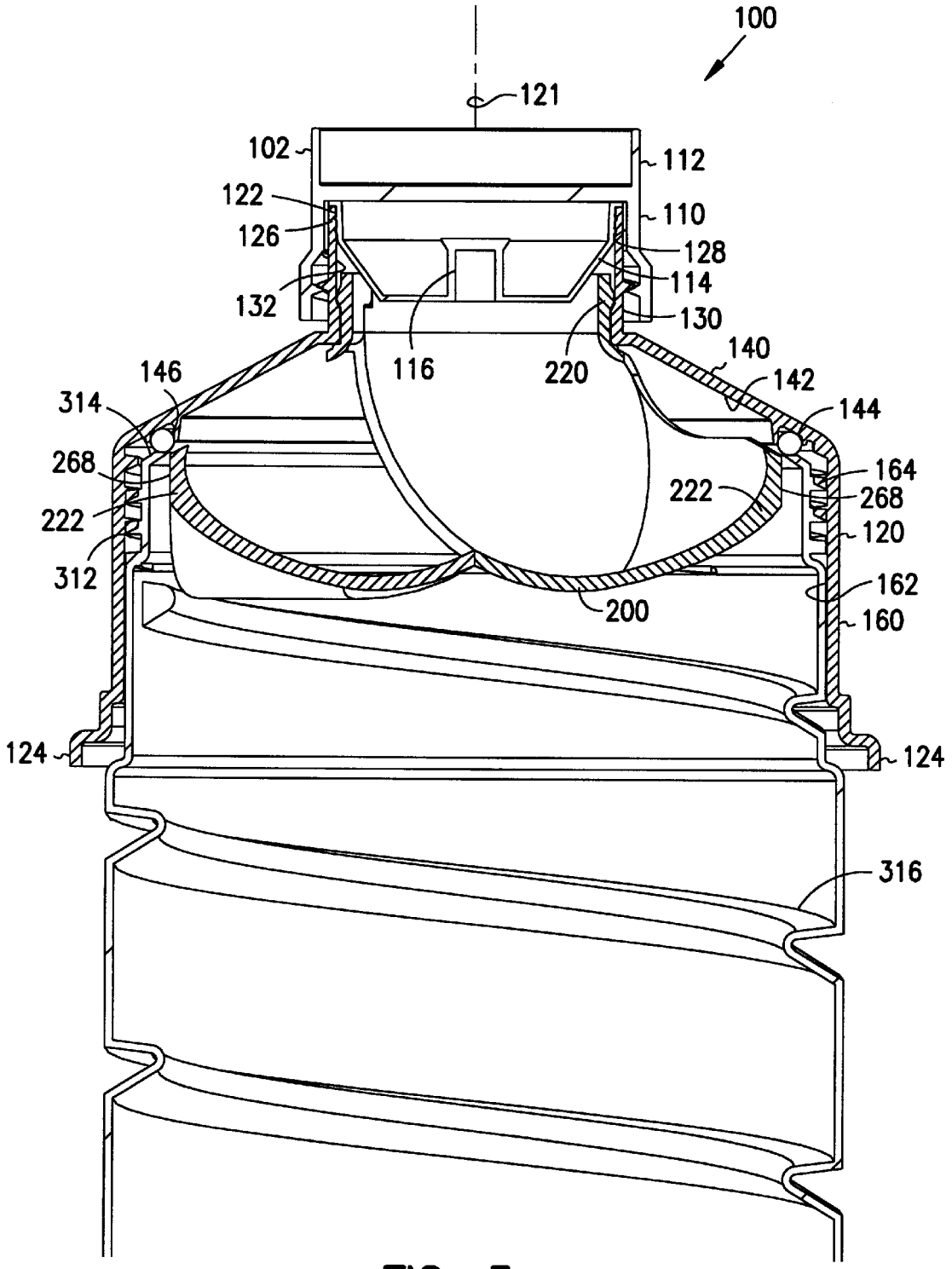
FIG. 3 illustrates a cross section view of a cartridge unit constructed in accordance with one embodiment of the present invention.

As mentioned above, the cartridge unit 100 includes a cap assembly 120 which is illustrated in greater detail in FIGS. 2 and 3. The cap assembly 120 extends from a proximal end 122 to a open distal end 124. Near the proximal end 122 of the cap assembly 120 is a mouth portion 126. The mouth portion 126 is substantially aligned with a central axis 121 of the cap assembly 120. The mouth portion 126 allows for the distribution of toner therethrough, as the cartridge unit 100 is rotated. In one embodiment, the cap assembly 120 comprises a drive cap assembly which is adapted to couple with the image developing apparatus and drive or rotate the cartridge unit 100, as will be further described below. Alternatively, the cartridge unit 100 can be driven using other components.

The mouth portion 126 is defined in part by an internal surface 128 (FIG. 4) and an external surface 130. In one embodiment, the external surface 130 of the mouth portion 126 includes external threads 312 for coupling with the distal end cap 112. The internal surface 128 of the mouth portion 126, as illustrated in greater detail in FIG. 4, includes at least one anti-rotation feature 132. In one embodiment, the anti-rotation feature 132 includes at least one cut out 134. The anti-rotation feature 132 is adapted to prevent components coupled therewith from rotating, as will be further discussed below. The cut out 134 could alternatively comprise a projection adapted for coupling with a component.

Referring to FIGS. 2 and 3, the cap assembly 120 further includes a shoulder portion 140 and a collar 160. The mouth portion 126 is disposed proximate to the shoulder portion 140, and the shoulder portion 140, is disposed proximate to the collar 160. The shoulder portion 140 is defined in part by an internal surface 142. In one embodiment, the internal surface 142 includes an annular groove 146. The annular groove 146 accommodates an annular gasket such as an O-ring 144. While described herein as an O-ring 144, gaskets and seals having other cross sectional shapes are also within the scope of the invention. The O-ring 144 provides a sealing surface for the toner bottle, as will be described below. Although an annular groove 146 is described, other structures permitting the O-ring 144 to be attached, coupled or seeded with the internal surface 142 of the shoulder portion 140 would also be acceptable. Alternatively, the O-ring 144 could be adhered to the internal surface 142 of the shoulder portion 140.

As mentioned above, the cap assembly 120 also includes a collar 160, which allows for the cap assembly 120 to be installed over a portion of the toner bottle. It should be noted that the cap assembly 120 can be formed integral with the cartridge. Alternatively, the cap assembly 120 can be removably coupled with the cartridge. The collar 160 is defined in part by an internal surface 162, which includes a threaded portion 164. The threaded portion 164 allows for the cap assembly 120 to be assembled with the toner bottle. Alternatively, the collar 160 or the cap assembly 120 can be assembled with the toner bottle in other manners, such as a snap fit assembly.

Figure 4:
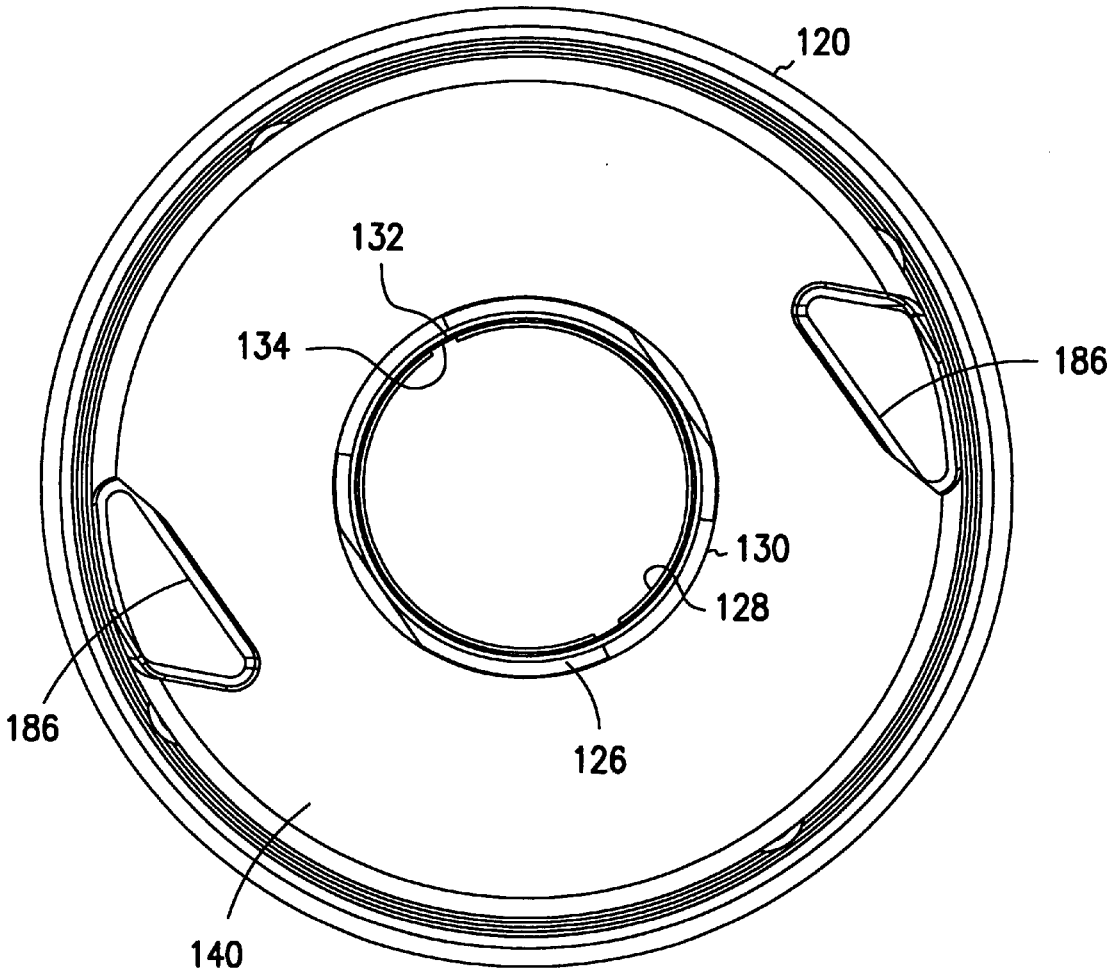
FIG. 4 illustrates a top plan view cap assembly constructed in accordance with one embodiment of the present invention.
Figure 5:
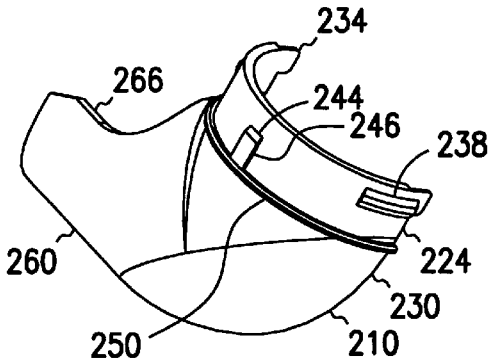
FIG. 5 illustrates a perspective view of a scoop constructed in accordance with one embodiment of the present invention.
Figure 6A:
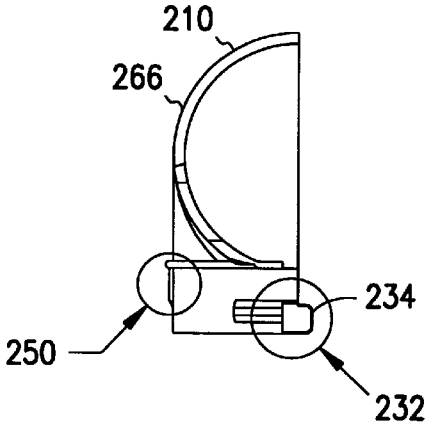
FIG. 6A illustrates a first side elevational view of a scoop constructed in accordance with one embodiment of the present invention.
Figure 6B:
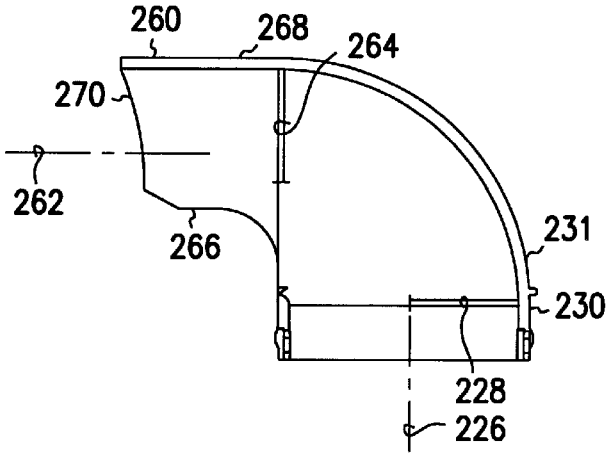
FIG. 6B illustrates a second side elevation view of a scoop constructed in accordance with one embodiment of the present invention.

In addition, the cap assembly 120 further includes drive lugs 186, as illustrated in FIGS. 2 and 4. The drive lugs 186 can be coupled with the cap assembly 120 or can be formed integral therewith. The drive lugs 186, in one embodiment, are disposed on the shoulder portion 140. The drive lugs 186 allow for the cartridge unit 100 to be rotated about a central axis 121. In one embodiment, the drive lugs 186 include a tapered portion 188 which facilitates insertion of the cartridge unit 100 into the developing apparatus.

To facilitate the distribution of toner from the cartridge unit 100, a scoop assembly 200 is provided therewith. The scoop assembly 200 can be seen in greater detail in FIGS. 2, 3. The scoop assembly 200, in one embodiment, includes a first scoop 210 and a second scoop 212 coupled therewith. Alternatively, the scoop assembly 200 can include a single scoop or alternatively can include two or more scoops. In one embodiment, the scoop assembly 200, including the first scoop 210 and the second scoop 212, has scoops which are each identical in size and shape. In another embodiment, each scoop extends from a proximal end 220 to a distal end 222.

The first and second scoops 210, 212 are coupled with the mouth portion 126 of the cap assembly 120 at the proximal end 220 of the first and second scoops 210, 212. The first and second scoops 210, 212 are coupled within the internal surface 128 of the mouth portion 126. In one embodiment, the first and second scoops 210, 212 are coupled within the internal surface 128 of the mouth portion 126 with a snap-fit coupling. Alternatively, the first and second scoops 210, 212 can be coupled using a fastener or adhesive.

In one embodiment, the first scoop 210 or the second scoop 212 includes a first portion 224 and a second portion 260. The first portion 224 of the first and/or second scoop 210, 212 is adapted to be coupled within the internal surface 128 of the mouth portion 126. The first portion 224 is defined in part by a first axis 226. In one embodiment, the first access 226 is aligned with a central access 121 of the cap assembly 120.

In one embodiment, the first portion 224 of the first and/or second scoop 210, 212 is defined by a semi-circular cross section 230. The semi-circular cross section 230 is defined by a radius having a length 228. In addition, the semi-circular cross section 230 has an outer edge 231. The first portion 224 further includes interlocking features 232 which are disposed, in one embodiment, near the proximal end 220 of the first and or second scoop 210, 212. In one embodiment, the interlocking features 232 include a first tab 234 and a second tab 238. The first and second tab 234, 238 are disposed, in another embodiment, on opposite sides of the semi-circular cross section 230.

The first portion 224 of the first and/or second scoop 210, 212 further include, in another embodiment, anti-rotation features 244. In one embodiment, the anti-rotation features 244 include a projection 246 which is adapted to couple with the cut out 134 of the cap assembly 120. In another embodiment, the first portion 224 further includes a ridge 250 which operates as a positive stop for the scoop assembly 200. The ridge 250 prevents the scoop assembly 200 from being inserted too far into the mouth portion 126 of the cap assembly 120.

Near the distal end 222 of the first and/or second scoop 210, 212 is a second portion 260. The second portion 260 is defined in part by a second axis 262. In one embodiment, the second access 262 is disposed transverse to the first axis 226. In another embodiment, the second portion 260 has a quarter-circular cross section 266 which is defined by a radius having length 264. In one embodiment, the length 264 of the quarter-circular cross section radius is the same as the length 228 of the semi-circular cross section 230 of the first portion 224. In another embodiment, the length 264 of the quarter-circular cross-section and the length 228 of the semi-circular cross section is substantially the same as the radius of the mouth portion 126. The second portion 260 is further defined by an outer edge 268, which in one embodiment, is aligned with the outer edge 231 of the first portion 224. The second portion 260 further includes a tapered distal end 270.

Figure 7:
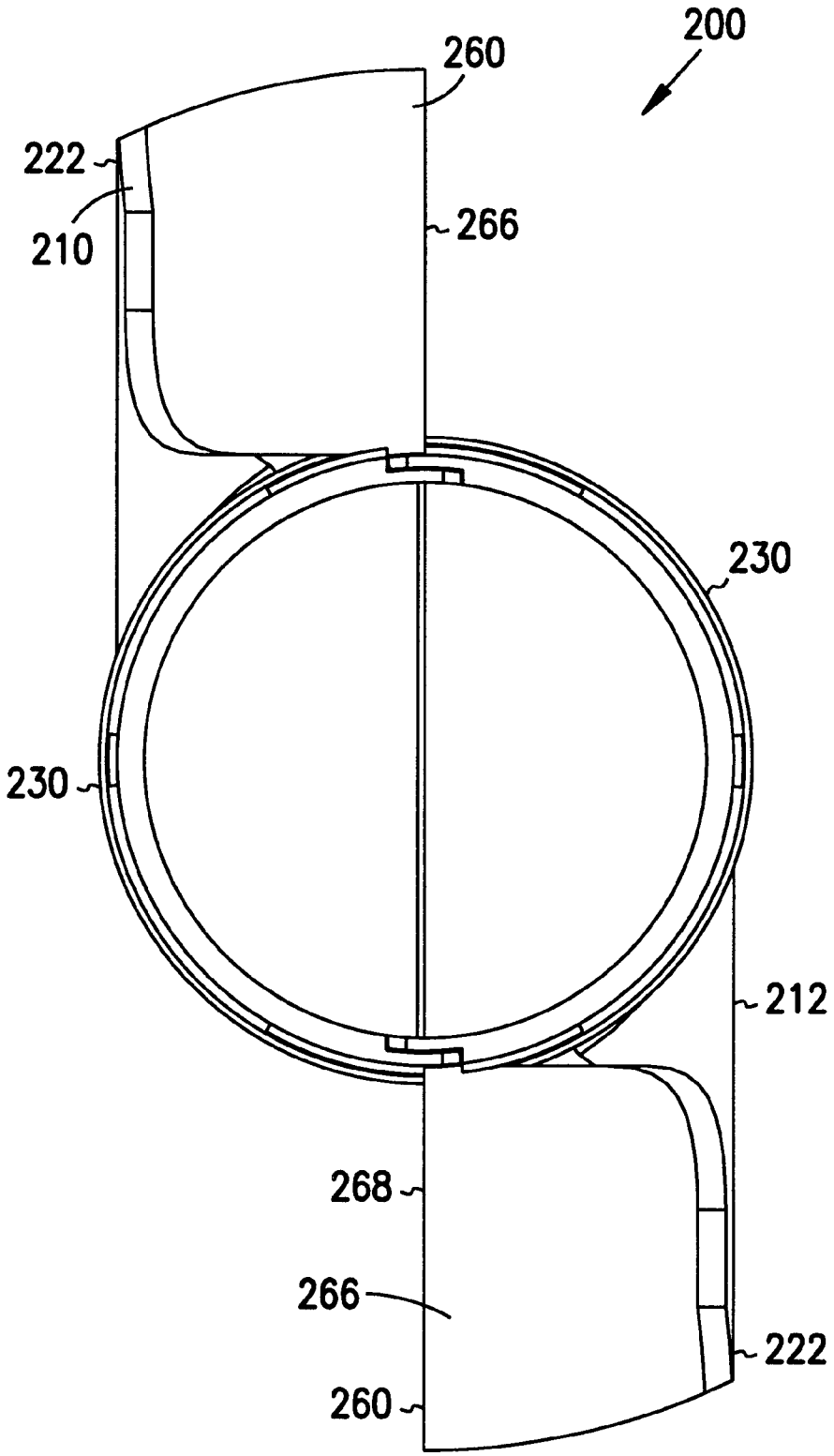
FIG. 7 illustrates a top plan view of a scoop assembly constructed in accordance with one embodiment of the present invention.

FIG. 7 illustrates an assembled scoop assembly 200 which includes the first scoop 210 and the second scoop 212. Once assembled, the first portion 224 of the first scoop 210 and the second scoop 212 are mated and form a circular cross-section. To assemble the first scoop 210 with the second scoop 212, a fixture can be used to snap fit the interlocking features 232 of the first and second scoops 210 and 212. In addition, the first scoop 210 is assembled with the second scoop 212 such that the second portion 260 of the first and second scoops 210, 212 are disposed opposite one another as shown in the figure.

Figure 8:
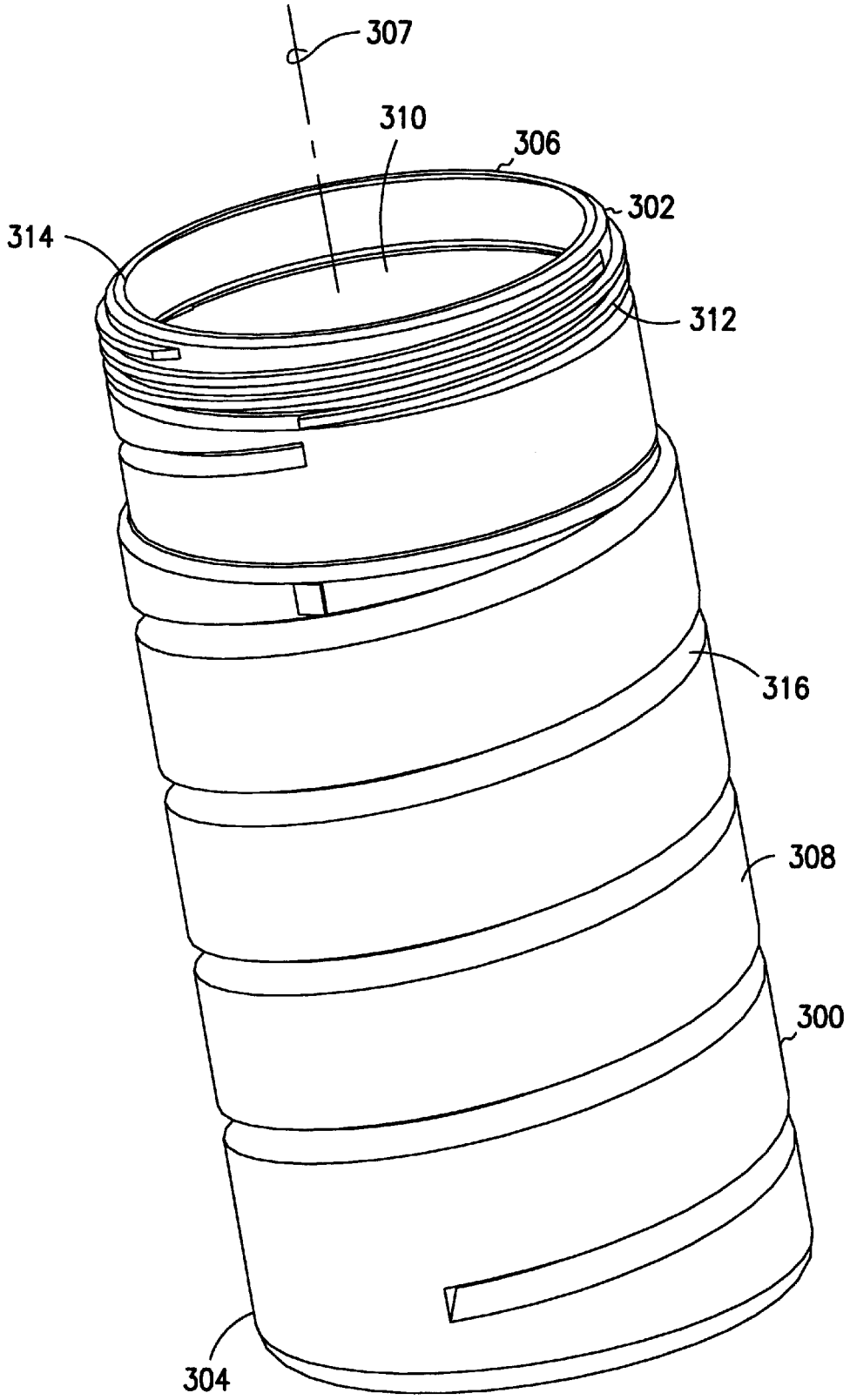
FIG. 8 illustrates a perspective view of a container constructed in accordance with one embodiment of the present invention.

As mentioned above, the cartridge unit 100 includes a toner bottle 300, which is illustrated in greater detail in FIG. 8. The toner bottle 300 generally comprises an elongate cylinder which extends from a proximal end 302 to a distal 304. In one embodiment, the proximal end 302 of the toner bottle 300 is adapted to be coupled with the cap assembly 120, as will be further described below. Near the proximal end 302 is open end 306 through which the toner passes through developing apparatus is operated. The toner bottle 300 is further defined by a central axis 307. The toner bottle 300 is adapted to rotate about the central axis 307 as the developing apparatus is operated and the cartridge unit 100 is rotated to replenish the supply of toner to the developing apparatus.

The toner bottle 300 is further defined by an external surface 308 and an internal surface 310. In one embodiment, external threads 312 are disposed proximate the proximal end 302 on the external surface 308. The external threads 312 allow for the toner bottle 300 to be coupled with the cap assembly 120. Alternatively, the toner bottle 300 can be coupled with the cap assembly 120 in other manners, for instance snap fit features. In another embodiment, a helical ramp 316 is disposed on the internal surface 310. The helical ramp 316 guides toner disposed within the toner bottle 300 along the internal surface 310 of the toner bottle 300 such that it passes through the proximal end 302. In yet another embodiment, the toner bottle 300 further includes a seating surface 314 which is adapted to seat against the O-ring 144 of the cap assembly 120.

The cap assembly 120, the scoop assembly 200, and the toner bottle 300 are each formed from a plastic material. Suitable materials for the formation of these components include high density polyethylene or low density polyethylene. In one embodiment, the sealing cap 114 is formed of low density polyethylene, and the toner bottle 300 and the distal end cap 112 are formed of high density polyethylene. However, the various components can be formed from a variety of plastic materials using various processes such as thermal forming, blow molding or injection molding.

To assemble the cartridge unit 100, toner is distributed into the toner bottle 300. The first scoop 210 is coupled to the second scoop 212 such that the interlocking features 232 couple the first scoop 210 with the second scoop 212. The scoop assembly 200 is then inserted into the mouth portion 126 of the cap assembly 120. Specifically, the scoop assembly 200 is installed to an internal surface 128 of the mouth portion 126. In one embodiment, when the scoop assembly 200 is installed within the mouth portion 126 neither the first portion 224 nor the second portion 260 of either the first scoop 210 or the second scoop 212 come into contact with the shoulder portion 140 of the cap assembly 120. In addition, neither the first scoop 210 nor the second scoop 212 contacts the collar 160 of the cap assembly 120. The scoop assembly 200 is coupled within the mouth portion 126 of the cap assembly 120 such that the scoop assembly 200 does not rotate relative to the cap assembly 120. The scoop assembly 200 can be coupled with the cap assembly 120 in a number of manners, including a snap fit coupling or adhesive. Alternatively, the scoop assembly 200 is prevented from rotating relative to the cap assembly 120 by the anti-rotation features 244 of the scoop assembly 200 and the anti-rotation features 132 of the cap assembly 120. In one embodiment, the projection 246 of the scoop assembly 200 is coupled within the cut out 134 of the cap assembly 120 to prevent rotation of the scoop assembly 200 relative to the cap assembly 120.

The toner bottle 300 is assembled with the cap assembly 120. The proximal end 302 of the toner bottle 300 is inserted into the open distal end 124 of the cap assembly 120 until the O-ring 144 is seated against the seating surface 314 of the toner bottle 300 as shown in FIG. 3. The external threads 312 of the toner bottle 300 are engaged with the internal threaded portion 164 of the cap assembly 120.

The end cap assembly 110 is assembled with the cap assembly 120, to prevent toner from exiting inadvertently from the cartridge unit 100. The sealing cap 114 is installed within the internal surface 128 of the mouth portion 126. The distal end cap 112 is installed over the mouth portion 126, such that the external threads disposed on the external surface 130 of the mouth portion 126 are engaged with threads of the distal end cap 112. The cartridge unit 100 is assembled and ready to be installed into a developing apparatus. It should be noted that the above-described steps of assembly can be conducted in an order different from that above.

During operation, the cartridge unit 100 rotates within the developing apparatus to distribute toner thereto. Prior to installing the cartridge unit 100 into the developing apparatus, the distal end cap 112 is removed from the cartridge unit 100. During operation of the developing apparatus, the sealing cap 114 is mechanically removed by the developing apparatus from the cap assembly 120.

During operation of the developing apparatus, when the developing apparatus determines that additional toner needs to be supplied thereto, the cartridge unit 100 rotates about a central axis. As the toner bottle 300 rotates about its central axis 307, toner disposed within the toner bottle 300 is guided towards the proximal end 302 of the toner bottle 300 by the helical ramp 316. The toner is further guided through the open end 306 toward the scoop assembly 200.

As the cartridge unit 100 is further rotated, toner is scooped by the first and/or second scoop 210, 212. The scoop assembly 200 guides the toner directly from the toner bottle 300 through the internal surface 128 of the mouth portion 126. The toner then is distributed through the mouth portion 126 and into the developing apparatus. Once sufficient toner has been delivered, the developing apparatus ceases the rotation of the cartridge unit 100 until further toner is needed. When the cartridge unit 100 has been substantially or completely emptied, the developing apparatus replaces the sealing cap 114 within the mouth portion 126. An operator can then safely remove the cartridge unit 100 from the developing apparatus, without toner residue or remaining toner being inadvertently distributed from the cartridge unit 100. Thus, the cartridge unit 100 assists in preventing excessive toner material being distributed within the developing apparatus and/or onto an operator's clothing.

Figure 9:
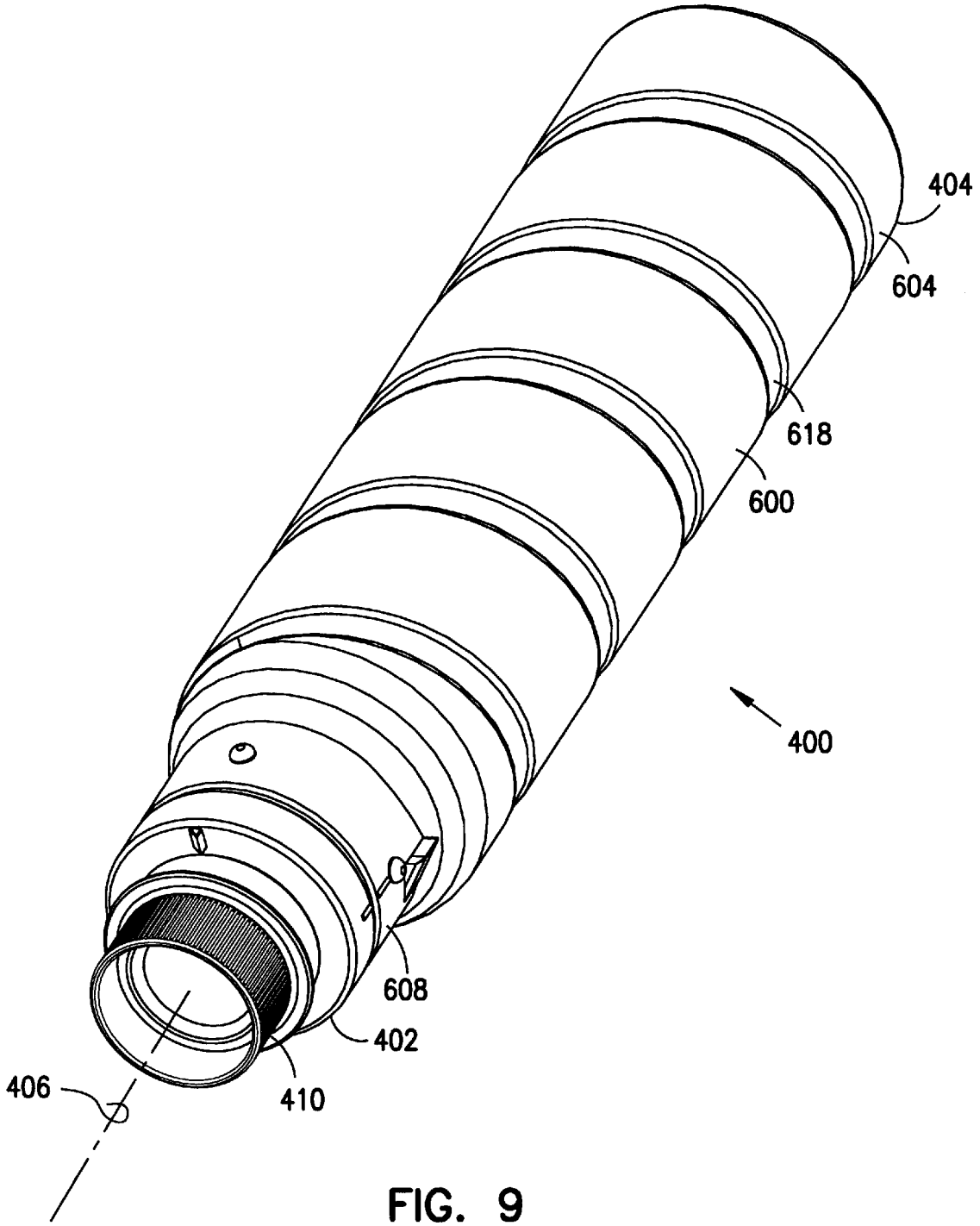
FIG. 9 illustrates perspective view of a cartridge unit constructed in accordance with yet another embodiment of the present invention.
Figure 10:
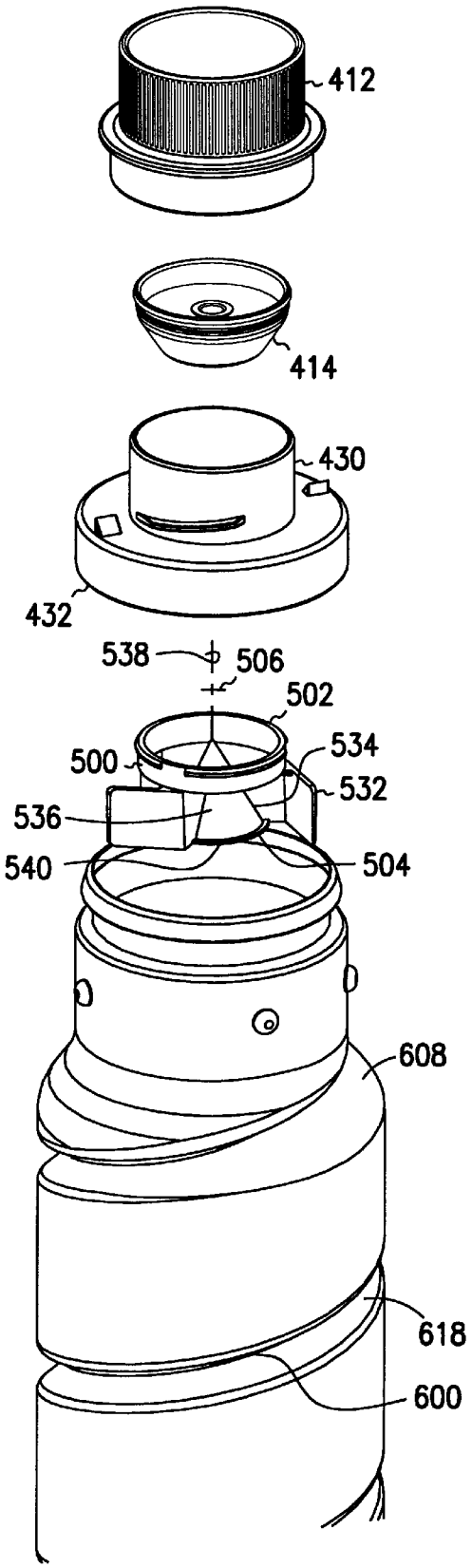
FIG. 10 illustrates an exploded perspective view of a cartridge unit constructed in accordance with one embodiment of the present invention.
Figure 11:
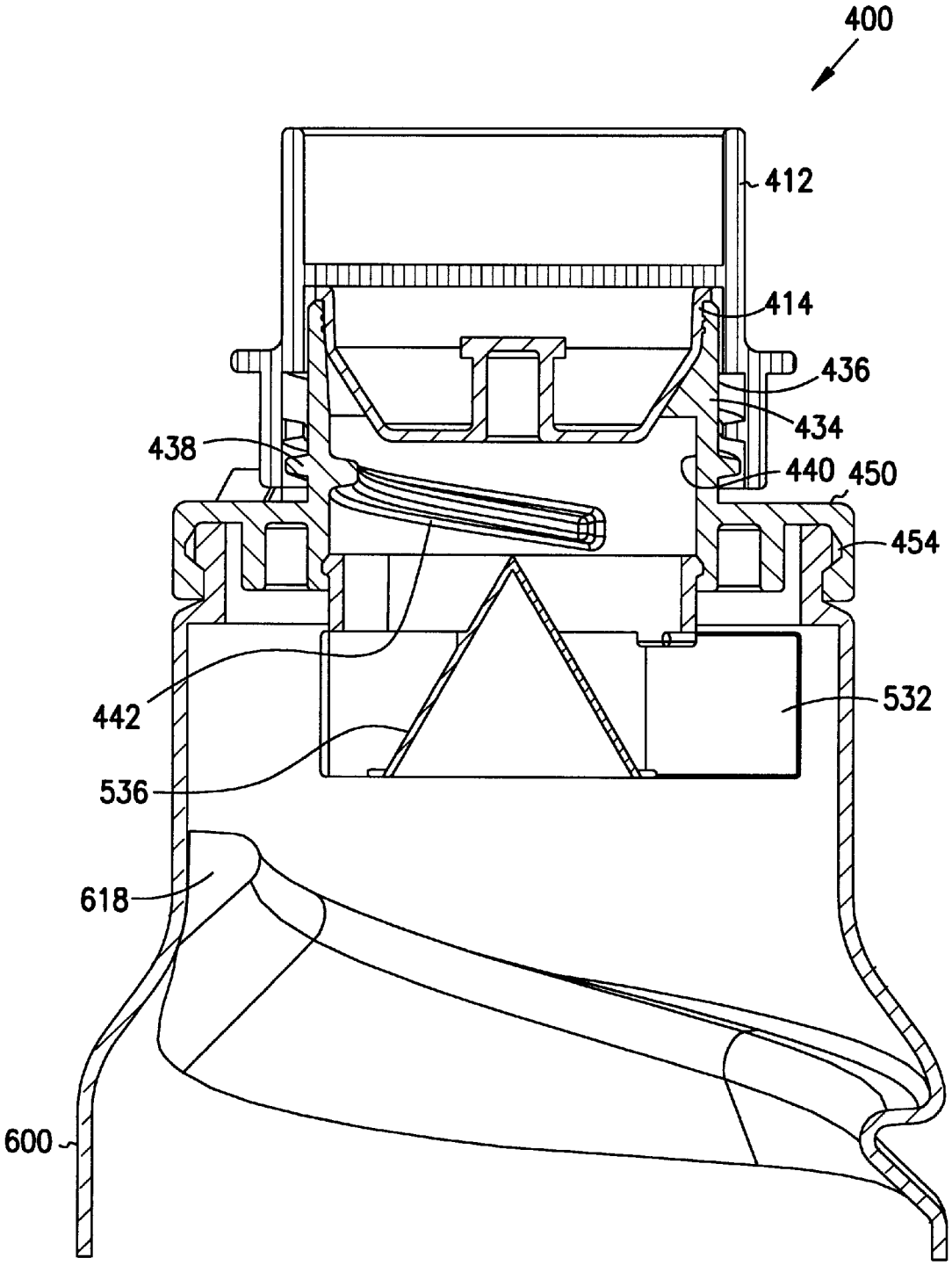
FIG. 11 illustrates a cross section view of a cartridge unit constructed in accordance with one embodiment of the present invention.

In another embodiment, a cartridge unit 400 is provided for supplying toner to a developing apparatus. The cartridge unit 400, as illustrated in FIGS. 9 and 11 extends from a proximal end 402 to a distal end 404. The cartridge unit 400 includes an end cap assembly 410, a cap assembly 430, a paddle scoop 500 and a toner bottle 600.

Disposed near the proximal end 402 of the cartridge unit 400 is the end cap assembly 410. The end cap assembly 410 includes a distal end cap 412 and an inner sealing cap 414. The distal end cap 412 is internally threaded such that it can be coupled with the mouth portion 434. Alternatively, the distal end cap 412 can be coupled with the mouth portion 434 of the cap assembly 430 in other manners, such as a snap-fit assembly. The outer end cap assembly 410 further includes a sealing cap 414. The sealing cap 414 fits within the mouth portion 434 and, when installed, is adapted for preventing toner from exiting the bottle. The sealing cap 414 includes a lug 416, which allows for the sealing cap 414 to be removed from the bottle by the developing apparatus.

A chucking portion of the developing apparatus is adapted to retain the lug 416 of the sealing cap 414. As the chuck is moved away from the bottle, the sealing cap 414 is moved to a position where the mouth portion 434 of the bottle is fully uncovered and toner can be freely distributed through the mouth portion 434 of the cap assembly 430. Once the toner in the bottle has been depleted, the sealing cap 414 is inserted into the mouth portion 434 such that the remaining toner will not exit the bottle as the cartridge unit 400 is removed from the developing apparatus.

The cap assembly 430 includes a cap 432. In one embodiment, the cap 432 includes a mouth portion 434 and a collar portion 450. The mouth portion 434 is defined in part by an external surface 436 and an internal surface 440. In one embodiment, the external surface 436 includes external threads 438. The external threads 438 are adapted to couple with the end cap assembly 410. The internal surface 440 of the mouth portion 434 is adapted to receive therein a scoop, as will be further described below. As illustrated in greater detail in FIG. 11, the internal surface 440 of the mouth portion 434 also includes an auger 442 which facilitates the distribution of toner through the mouth portion 434 and into the developing apparatus.

Figure 14:
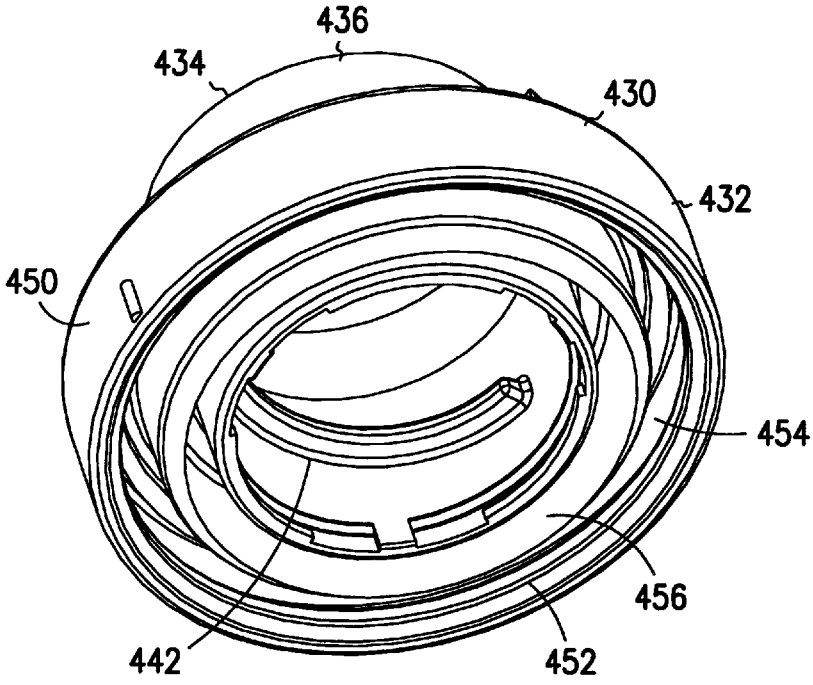
FIG. 14 illustrates a perspective view of a cap assembly constructed in accordance with yet another embodiment of the present invention.
Figure 15:
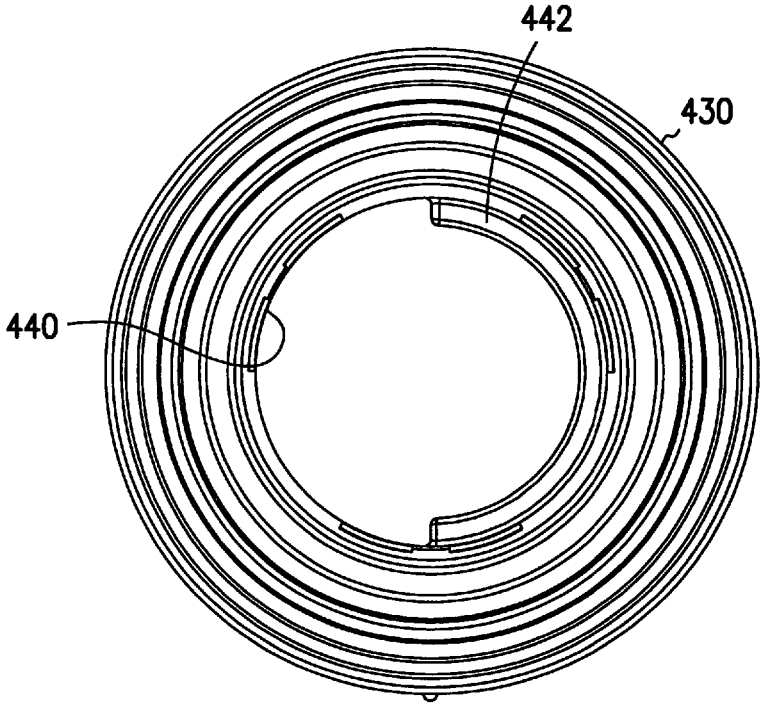
FIG. 15 illustrates a bottom plan view of a cap assembly constructed in accordance with one embodiment of the present invention.

The collar portion 450 is adapted to be coupled with the toner bottle, as will be further discussed below. The collar portion 450, as illustrated in greater detail in FIGS. 14 and 15, includes a plurality of coupling features 452 which facilitate the coupling of the collar portion 450 with the toner bottle. In one embodiment, the coupling features 452 include a first annular groove 454. Alternatively, in another embodiment, the coupling features 452 include a second annular groove 456 which is provided in alternative to the first annular groove 454 or can be provided in conjunction with the first annular groove 454.

Figure 12:
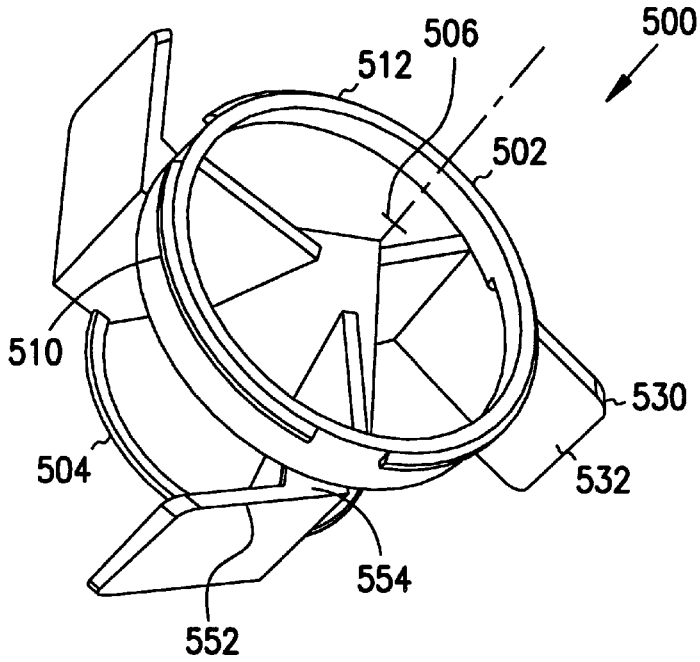
FIG. 12 illustrates a perspective view of a paddle scoop constructed in accordance with one embodiment of the present invention.
Figure 13:
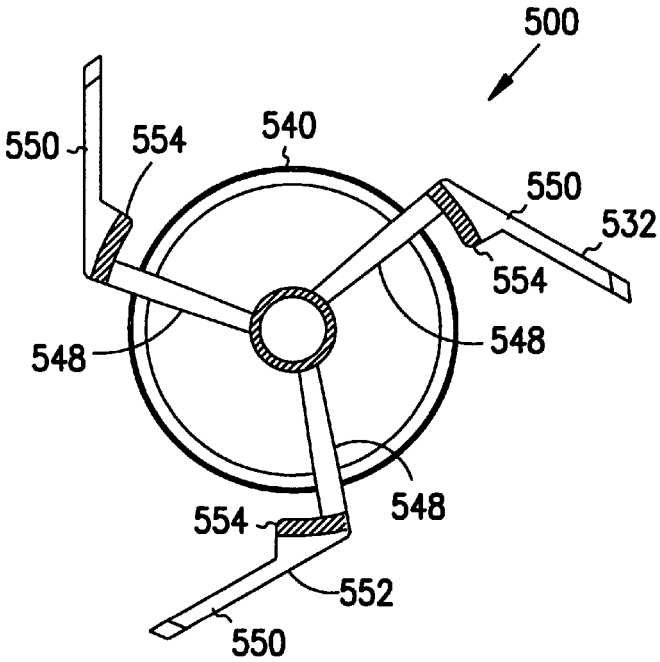
FIG. 13 illustrates a top plan view of a paddle scoop constructed in accordance with another embodiment of the present invention.

To facilitate distribution of the toner from the cartridge unit 400, the cartridge unit 400 further includes a paddle scoop 500, as illustrated in FIGS. 12 and 13. The paddle scoop 500 extends from a proximal end 502 to a distal end 504 and is adapted to rotate about a central axis 506. The paddle scoop 500 further includes coupling features 510 which allow for the paddle scoop 500 to be coupled with the cap assembly 430. In one embodiment, the coupling features 510 include at least one coupling ring 512. The coupling ring 512 is adapted to be received by the first annular groove 454 or the second annular groove 456 of the cap 432. Alternatively, the coupling features 510 such as the coupling ring 512 are received within the internal surface 440 of the mouth portion 434. The coupling features 510 allow for the paddle scoop 500 to be assembled to the cap assembly 430 in a number of manners. For instance, the coupling features 510 can snap fit with the coupling features 452 of the cap assembly 430.

The paddle scoop 500 further includes toner movement features 530 which facilitate distributing toner through the mouth portion 434 of the cap assembly 430 and into the developing apparatus. In one embodiment, the toner movement features 530 include at least one scoop 532. In another embodiment, the toner movement features 530 include a plurality of scoops 532. In addition, the toner movement features 530 include a distribution member 534. In one embodiment, the distribution member 534 comprises a cone 536 centered about a central axis 538. In one embodiment the central axis 538 is aligned with the central axis 506. The distribution member 534 flier includes a flange 540, which prevents toner from falling back into the toner bottle. The distribution member 534 extends from the flange 540 to a distal tip 542.

Each scoop 532 includes a first portion 548 and a second portion 550. In one embodiment, the first portion 548 is disposed at an angle to the second portion 550. In another embodiment, the first portion 548 is disposed at substantially transverse to the second portion 550. The scoop 532 includes at least one side edge 552 which in one embodiment includes a flange 554 coupled therewith. The flange 554 provides additional stability between the first portion 548 and the second portion 550 of each scoop 532.

In one embodiment, the coupling ring 512 is secured to the side edge 552 of the scoop 532. The first portion 548 of each scoop 532 is coupled with the distribution member 534 as shown in the figure. The second portion 550 is then coupled with the first portion 548. In one embodiment, the first portion 548 is coupled with the distribution member 534 such that the first portion 548 is aligned with the central axis 538 of the cone 536. The scoop 532 is coupled with the distribution member 534 such that as the paddle scoop 500 is rotated the scoop 532 lifts counter to the distribution member 534. The distribution member 534 then translates the toner through the mouth portion 434 of the cap assembly 430 and into the developing apparatus.

Figure 16:
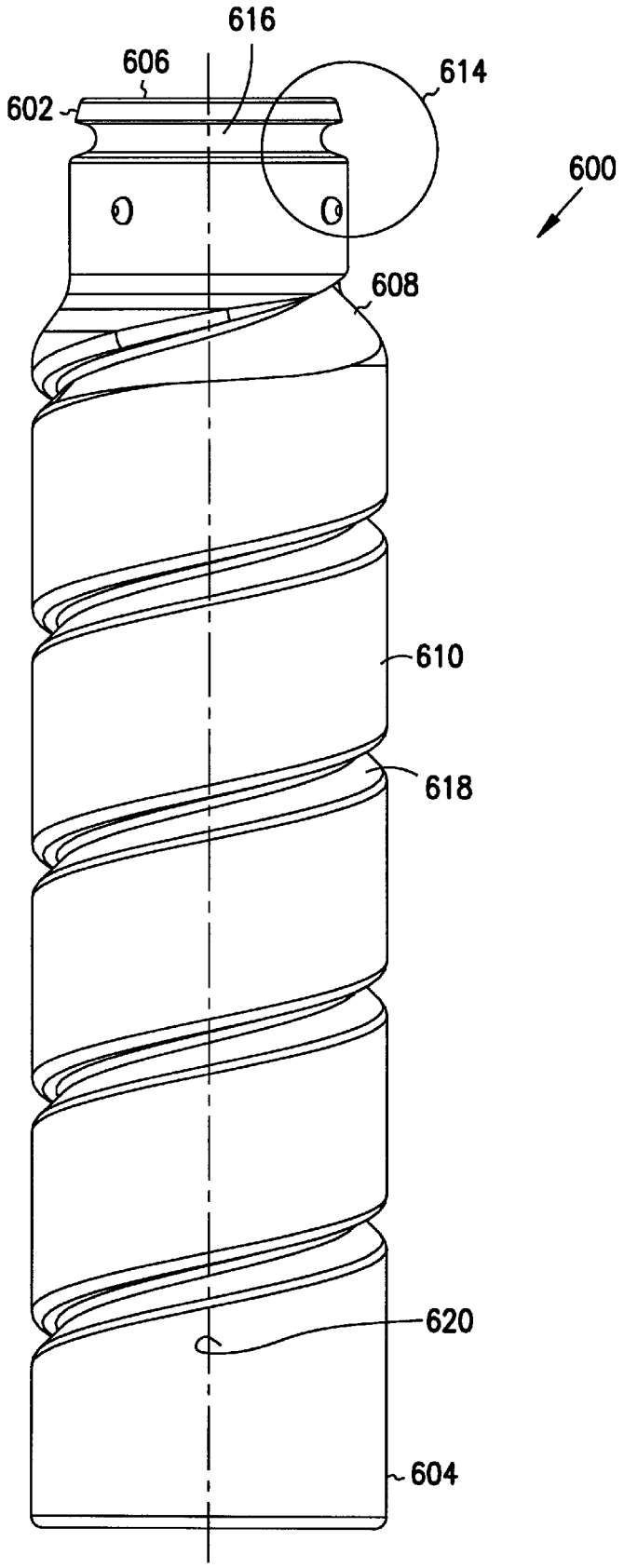
FIG. 16 illustrates a side elevational of a container constructed in accordance with one embodiment of the present invention.

The cartridge unit 400 further includes a toner bottle 600. The toner bottle, as illustrated in greater detail in FIG. 16, extends from a proximal end 602 to a distal end 604. Near the proximal end 602 is an open end 606 through which toner is distributed as the cartridge unit 400 is rotated by the developing apparatus. In another embodiment, the toner bottle 600 has a first diameter near the distal end 604 which is greater than a second diameter near the proximal end 602 and transitions from the first diameter to the second diameter at a tapered portion 608.

A toner bottle 600 is further defined by an external surface 610, an internal surface and is adapted to rotate about a central access 620. Disposed within the internal surface of the toner bottle 600 is a helical ramp 618 which acts as a guide for the toner to move the toner from the distal end 604 toward the proximal end 602 and through the open end 606 of the toner bottles 600. In another embodiment, the toner bottle 600 includes at least one coupling feature 614 near the proximal end 602. In one embodiment, the coupling feature 614 comprises a groove 616 which is adapted to couple with the cap assembly 430.

Figure 17:
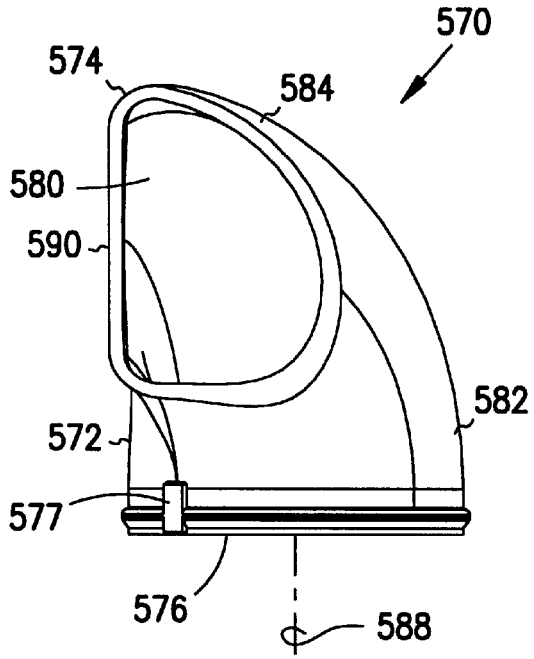
FIG. 17 illustrates a first side elevational view of a scoop constructed in accordance with one embodiment of the present invention.
Figure 18:
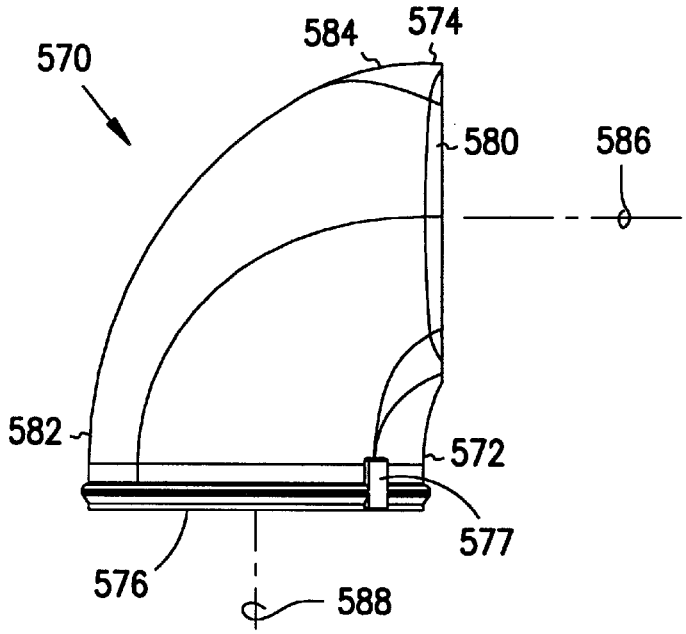
FIG. 18 illustrates a second side elevational view constructed in accordance with another embodiment of the present invention.

In another embodiment, a scoop 570 is provided with a cartridge unit 400. The scoop 570 is illustrated in more detail in FIGS. 17 and 18. The scoop 570 extends from a proximal end 572 to a distal end 574. Near the proximal end 572 are coupling features 576 which allow for the scoop 570 to be coupled with the cap assembly 430. The coupling features 576, in one embodiment, comprise snap-fit coupling features. In another embodiment, the coupling features 576 allow for the scoop 570 to be coupled with the coupling features 452 of the cap assembly 430. In one embodiment, the scoop 570 couples within the second annular groove 456 of the cap assembly 430. Alternatively, the scoop 570 couples within the internal surface 440 of the mouth portion 434. In yet another embodiment, the scoop 570 includes anti-rotation features 577 disposed near the proximal end 572.

The scoop 570, in one embodiment, comprises an enclosed conduit which extends from the proximal end 572 to the distal end 574. The enclosed conduit is arcuately curved as the scoop 570 transitions from the proximal end 572 to the distal end 574. The enclosed conduit is continuously enclosed as the scoop 570 transitions from the proximal end 572 to the distal end 574, which assists in the efficient distribution of toner from the bottle 600 through the mouth portion 434 of the cap assembly 430. Near the proximal end 574 of the scoop 570 is a first portion 582. The first portion 582, in one embodiment, is defined in part by a first axis 586 and has a circular cross-section. Near the distal end 574 of the scoop 570 is a second portion 584, including an open end 580 which allows for toner to be distributed into the developing apparatus. The second portion 584 is defined in part by a second axis 588. In one embodiment, the second portion 584 includes a generally circular cross-section. In another embodiment, the second portion 584 includes a flattened edge 590. When the scoop 570 is assembled within the cartridge unit 400, the first axis 586 is aligned with a central axis 620 of the toner bottle 600. In another embodiment, the second axis 588 is disposed substantially transverse to the first axis 586.

To assemble the cartridge toner is distributed into the toner bottle 600. A toner distribution member such as a paddle scoop 500 or the scoop 570 is coupled with the cap assembly 430. In one embodiment, the paddle scoop 500 is coupled within the mouth portion 434 of the cap assembly 430. Alternatively, the scoop 570 is coupled within the mouth portion 434 of the cap assembly 430. The cap assembly 430 is coupled with the toner bottle 600. It should be noted that the cap assembly 430 can be removably coupled with the toner bottle 600. Alternatively, the cap assembly 430 can also be formed integral with the toner bottle 600. The end cap assembly 410 is coupled with the cap assembly 430, similar to the embodiments discussed above.

During operation, the developing apparatus is adapted to rotate the cartridge unit 400 about its central axis 406 upon a determination that more toner is necessary for the developing apparatus. As the cartridge unit 400 is rotated, toner is guided by the helical ramp 618 of the toner bottle 600, such that toner within the toner bottle 600 is guided toward the proximal end 602 of the toner bottle 600. The toner is distributed through the open end 606 toward the cap assembly 430. As the toner is guided closer toward the proximal end 602, the toner eventually encounters the paddle scoop 500 and/or the scoop 570. When the toner encounters the paddle scoop 500, toner movement features 530 such as the scoop 532 lift the toner to a distribution member 534. As the toner strikes the distribution member 534 or the cone 536, toner is guided by the cone 536 through the mouth portion 434 of the cap assembly 430. The toner is then distributed through the mouth portion 434 to the developing apparatus until the developing apparatus sends a signal that no more toner is necessary.

Once the supply of toner within the cartridge unit 400 is exhausted, the inner sealing cap 414 is replaced within the mouth portion 434 of the cap assembly 430. An operator then removes the cartridge unit 400 from the developing apparatus. The inner sealing cap 414 prevents the remaining residue of toner or remaining toner from being inadvertently distributed from the cartridge unit 400.

It should be noted that the above-discussed embodiments shown in the various figures can be used interchangeably. For instance, the scoop 570 shown in FIGS. 17 and 18 can be incorporated with the cartridge unit 100 illustrated in FIGS. 1 and 2. The modularity allows for increased flexibility in manufacturability of the cartridge unit since toner powder can vary in its consistency and the manner in which it is distributed. In addition, a particular developing apparatus may need a more efficient distribution of toner than another machine, which can be accommodated by changing the toner distribution mechanism disposed within the container.

Advantageously, the cartridge unit described herein provides a convenient way to draw toner from the toner bottle through the mouth portion of the cap assembly. The various configurations of the toner distribution features allow for a variety of types of toner to be used and yet the velocity of distribution can be ensured. In addition, the dispense rate can be increased. A further advantage provided is that the parts are modular and can be interchangeably used to allow for different types of toner.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A cartridge unit for use with a toner cartridge assembly of an image developing device, the cartridge unit comprising:

a cartridge including a toner bottle coupled with a cap assembly;

the toner bottle having an elongate cylindrical structure and defined in part by a central axis, the toner bottle containing developer therein;

the cap assembly including a mouth portion; and at least one scoop apparatus coupled to an internal surface of the mouth portion of the cap assembly, the at least one scoop apparatus extending at least partially within the mouth portion and adapted for drawing developer from the toner bottle through the mouth portion as the toner bottle is rotated about the central axis.

2. The cartridge unit as recited in claim 1, wherein the at least one scoop apparatus is coupled within the mouth portion with a snap fit coupling.

3. The cartridge unit as recited in claim 1, the cap assembly further comprising an annular gasket, the annular gasket disposed between the cap assembly and a proximal end of the toner bottle.

4. The cartridge unit as recited in claim 3, the cap assembly further comprising a slot adapted to receive the annular gasket therein.

5. The cartridge unit as recited in claim 1, wherein the at least one scoop apparatus comprises two scoops coupled within the mouth portion.

6. The cartridge unit as recited in claim 1, wherein the at least one scoop apparatus includes at least one scoop including a first portion proximate to the mouth portion, and a second portion proximate to a distal end of the at least one scoop, the first portion defined in part by a first axis and the second portion defined in part by a second axis.

7. The cartridge unit as recited in claim 6, wherein the first axis is coaxially aligned with a central axis of the mouth portion and the second axis is transverse to the first axis.

8. The cartridge unit as recited in claim 6, wherein the first portion has a semi-circular cross-section.

9. The cartridge unit as recited in claim 6, wherein the second portion has a quarter-circular cross-section.

10. The cartridge unit as recited in claim 6, wherein an outer edge of the first portion is aligned with an outer edge of the second portion.

11. A cartridge unit for use with a toner cartridge assembly of an image developing device, the cartridge unit comprising:

a cartridge including a toner bottle coupled with a cap assembly;

the toner bottle having an elongate cylindrical structure and defined in part by a central axis, the toner bottle containing developer therein;

the cap assembly including a mouth portion, a shoulder portion, and a collar, the collar disposed over a portion of the toner bottle; and at least one scoop apparatus coupled to an internal surface of the mouth portion of the cap assembly, the at least one scoop apparatus comprising two scoops coupled within the mouth portion adapted for drawing developer from the toner bottle through the mouth portion as the toner bottle is rotated about the central axis, the at least one scoop apparatus including at least one scoop having a first portion proximate to the mouth portion, and a second portion proximate to a distal end of the at least one scoop, the first portion defined in part by a first axis and the second portion defined in part by a second axis.

12. The cartridge unit as recited in claim 11, wherein the first axis is coaxially aligned with a central axis of the mouth portion and the second axis is transverse to the first axis.

13. The cartridge unit as recited in claim 11, wherein the at least one scoop apparatus is coupled within the mouth portion with a snap fit coupling.

14. The cartridge unit as recited in claim 13, wherein the scoop apparatus has an anti-rotation feature associated therewith, the anti-rotation feature adapted for preventing the scoop apparatus from moving relative to the cap assembly.

15. The cartridge unit as recited in claim 11, the cap assembly further comprising an annular gasket, the annular gasket disposed between the cap assembly and a proximal end of the toner bottle.

16. A cartridge unit for use with a toner cartridge assembly of an image developing device, the cartridge unit comprising:

a cartridge including a toner bottle coupled with a cap assembly;

the toner bottle having an elongate cylindrical structure and defined in part by a central axis, the toner bottle containing developer therein;

the cap assembly including a mouth portion and a collar;

at least one scoop apparatus coupled with the collar of the cap assembly, the at least one scoop apparatus adapted for drawing developer from the toner bottle through the mouth portion as the toner bottle is rotated about the central axis; and the at least one scoop apparatus comprising at least one scoop coupled with a distribution member.

17. The cartridge unit as recited in claim 16, wherein the distribution member comprises a cone aligned with the central axis of the toner bottle.

18. The cartridge unit as recited in claim 17, wherein the cone further comprises a flange.

19. The cartridge unit as recited in claim 16, wherein the at least one scoop apparatus includes three scoops.

20. The cartridge unit as recited in claim 19, wherein each scoop includes a first portion coupled with a second portion, the first portion coupled with the distribution member.

21. The cartridge unit as recited in claim 16, wherein a distal portion of the distribution member is disposed within the mouth portion of the toner bottle.

22. The cartridge unit as recited in claim 16, wherein the collar includes coupling features integral therewith.

23. The cartridge unit as recited in claim 22, wherein the coupling features include at least one annular groove disposed within the collar.

24. The cartridge unit as recited in claim 16, wherein the distribution member comprises a cone aligned with the central axis of the toner bottle, the cone further comprises a flange, and the at least one scoop apparatus includes three scoops.

25. A cartridge unit for use with a toner cartridge assembly of an image developing device, the cartridge unit comprising:

a cartridge including a toner bottle coupled with a cap assembly;

the toner bottle having an elongate cylindrical structure and defined in part by a central axis, the toner bottle containing developer therein;

the cap assembly including a mouth portion;

at least one scoop apparatus coupled to an internal surface of the mouth portion of the cap assembly, the at least one scoop apparatus extending at least partially within the mouth portion and adapted for drawing developer from the toner bottle through the mouth portion as the toner bottle is rotated about the central axis;

wherein the at least one scoop apparatus includes at least one scoop including a first portion proximate to the mouth portion, and a second portion proximate to a distal end of the at least one scoop, the first portion defined in part by a first axis and the second portion defined in part by a second axis; and wherein the first portion has a semi-circular cross-section.

26. A cartridge unit for use with a toner cartridge assembly of an image developing device, the cartridge unit comprising:

a cartridge including a toner bottle coupled with a cap assembly;

the toner bottle having an elongate cylindrical structure and defined in part by a central axis, the toner bottle containing developer therein;

the cap assembly including a mouth portion;

at least one scoop apparatus coupled to an internal surface of the mouth portion of the cap assembly, the at least one scoop apparatus extending at least partially within the mouth portion and adapted for drawing developer from the toner bottle through the mouth portion as the toner bottle is rotated about the central axis;

wherein the at least one scoop apparatus includes at least one scoop including a first portion proximate to the mouth portion, and a second portion proximate to a distal end of the at least one scoop, the first portion defined in part by a first axis and the second portion defined in part by a second axis; and wherein the second portion has a quarter-circular cross-section.

27. A cartridge unit for use with a toner cartridge assembly of an image developing device, the cartridge unit comprising:

a cartridge including a toner bottle coupled with a cap assembly;

the toner bottle having an elongate cylindrical structure and defined in part by a central axis, the toner bottle containing developer therein;

the cap assembly including a mouth portion, a shoulder portion, and a collar, the collar disposed over a portion of the toner bottle;

at least one scoop apparatus coupled to an internal surface of the mouth portion of the cap assembly, the at least one scoop apparatus comprising two scoops coupled within the mouth portion adapted for drawing developer from the toner bottle through the mouth portion as the toner bottle is rotated about the central axis, the at least one scoop apparatus including at least one scoop having a first portion proximate to the mouth portion, and a second portion proximate to a distal end of the at least one scoop, the first portion defined in part by a first axis and the second portion defined in part by a second axis;

wherein the at least one scoop apparatus is coupled within the mouth portion with a snap fit coupling; and wherein the scoop apparatus has an anti-rotation feature associated therewith, the anti-rotation feature adapted for preventing the scoop apparatus from moving relative to the cap assembly.

* * * * *